United States Patent [19]

Lothmann et al.

[11] Patent Number: 4,896,801

[45] Date of Patent: Jan. 30, 1990

[54] METHOD FOR CONTROLLING THE DISCHARGE CHANNEL OF A CASTING CONTAINER (TUNDISH) FOR METALLIC MELTINGS, AND A DEVICE FOR CARRYING OUT THE METHOD

[75] Inventors: Josef Lothmann, Langerwehe; Friedhelm Paulus, Hurtgenwald; Ludwig Walther, Duren/Niederau, all of Fed. Rep. of Germany

[73] Assignee: Flo-Con Systems, Inc., Champaign, Ill.

[21] Appl. No.: 49,703

[22] Filed: May 13, 1987

[30] Foreign Application Priority Data

May 13, 1986 [DE] Fed. Rep. of Germany ..... 161152

[51] Int. Cl.[4] ..... B22D 37/00

[52] U.S. Cl. ..... 222/590; 222/600

[58] Field of Search ..... 222/600, 598, 591, 594, 222/596, 570; 266/45, 236, 275, 287

[56] References Cited

U.S. PATENT DOCUMENTS 3,773,226 11/1973 Kutzer ..... 222/600
4,253,647 3/1981 Andres ..... 266/236
4,759,479 7/1988 Tinnes ..... 222/600

FOREIGN PATENT DOCUMENTS 66118 1/1985 European Pat. Off. .

*Primary Examiner*—S. Kastler
*Attorney, Agent, or Firm*—Richard M. Saccocio

[57] ABSTRACT

A method and apparatus of controlling the pouring spout of a tundish for molten metals, including a slide valve composed of a valve member mounted for movement between a head plate disposed on the underside of the tundish and a discharge member. For preventing in a particularly effective way any freezing of the molten metal and for avoiding any static shadow corners the valve member and/or the head plate or both in the closed and/or open or part-open position thereof are moved in such a way that a two-dimensional relative movement perpendicular to the longitudinal axis of the pouring spout is generated between the valve member and the head plate.

11 Claims, 5 Drawing Sheets

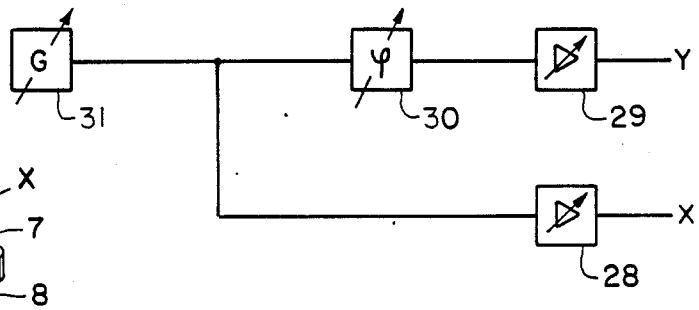
FIG.8
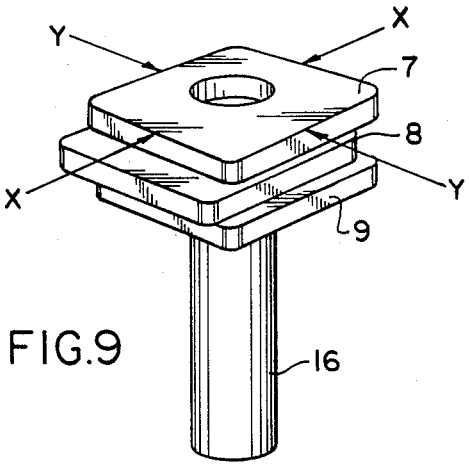
FIG.9
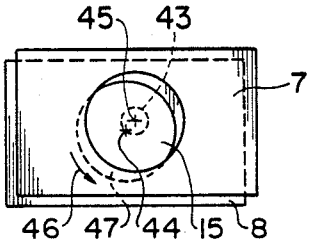
FIG.10a
FIG.10b
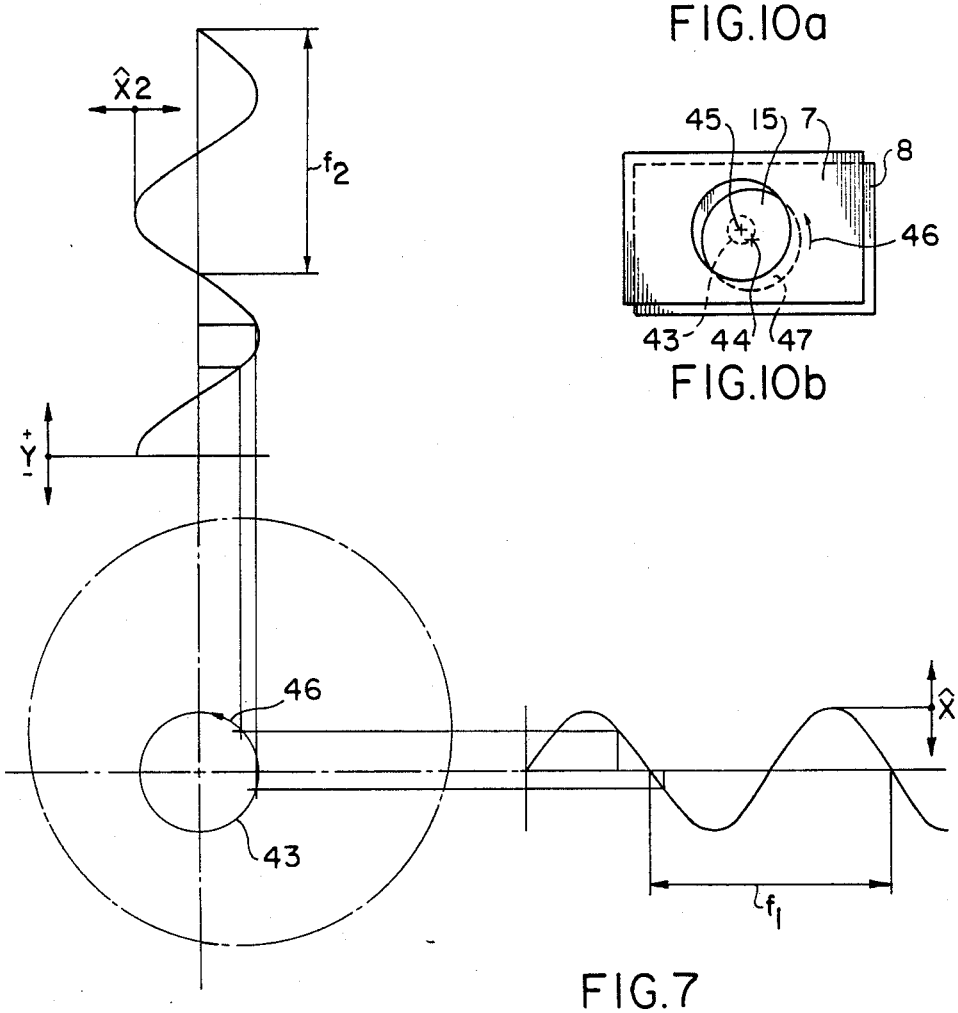
FIG.7

METHOD FOR CONTROLLING THE DISCHARGE CHANNEL OF A CASTING CONTAINER (TUNDISH) FOR METALLIC MELTINGS, AND A DEVICE FOR CARRYING OUT THE METHOD

BACKGROUND OF THE INVENTION

The invention is directed to a method of controlling the pouring spout of a tundish for molten metals, and a casting apparatus for performing said method.

In continuous casting, the emphasis has been in controlling the pouring spout in such a way that a predetermined level of the bath surface in the mold and/or the tundish is achieved and maintained. For some time now, those skilled in the art have been concerned with the problem how the freezing of the pouring spout of a tundish, which is provided with a slide valve, can be prevented not only prior to tapping but also during casting interruptions or breakdowns of short duration. To this end the U.S. Pat. Specification No. 3,773,226 proposes to inject an inert gas into the pouring spout while the valve plate is in its closed state. Thereby the molten metal in the pouring spout is to be circulated in such a way that colder molten metal is mixed with warmer molten metal. In this way solidification of the molten metal in the pouring spout is prevented or at least delayed. But the disadvantages are, firstly, the relatively high operating costs due to the use of expensive inert gas, and secondly the fact that the molten metal is cooled by the injected cold gas. Due to the last-mentioned effect it may even happen in case of insufficient circulation of the molten metal that the latter freezes almost abruptly, even though the intention is to prevent such freezing. Finally, care must be taken that the gas is always injected at a pressure which overcomes the ferrostatic pressure in the pouring spout; otherwise there would be risk of the gas inlet orifices choking due to penetration of molten metal therethrough.

To avoid these disadvantages it is proposed in EP-A-66,118 that during casting interruptions the movable valve member of the slide valve in its closed position is oscillatingly driven in the direction of the opening and closing movement of the valve member. To this end the valve member is coupled to a vibrating means controlled by an oscillator. In many cases this last-mentioned proposal is sufficient; but in critical situations, i.e. in case of an unforeseeable prolonged casting interruption or breakdown, freezing of the molten metal cannot always be reliably excluded even by the use of said proposal.

One object therefore is the further improvement of the last-mentioned method and the associated casting apparatus so that also during critical periods of prolonged casting interruptions or breakdowns freezing of the molten metal in the pouring spout is reliably prevented.

It is furthermore desirable to prevent quiescent or no-flow zones in the pouring spout, especially in the vicinity of the slide valve, so as to avoid oxide deposits in said zones for example when pouring aluminium-killed steel. To this end it is proposed in the above-specified EP-A-66,118 that from time to time the valve member (valve plate) is moved from the choked valve position to the fully open position. Thereby the flow path of the molten metal through the valve is temporarily straightened. The oxide deposits, which in the choked state have formed preferably in the quiescent zones (shadow corners) are washed out. But a disadvantage of this process is the unavoidable variation of the free cross-section of the pouring spout, whereby a corresponding readjustment of the bath level in the mold becomes necessary. Moreover, the "washout" effect is relatively limited, especially when somewhat excessive time periods are selected between washing-out operations.

It is therefore a further object of the invention to control the pouring spout of a tundish for molten metal in such a way that deposits in quiescent zones will not be formed in the first place.

Finally, a still unsolved problem is the ingress of ambient air into the pouring spout between the abutting surfaces of the head plate the and bottom member of the tundish, on the one hand, and the valve plate and the head plate or the valve plate and the discharge member, on the other hand. The ambient air drawn into the pouring spout during casting is a serious metallurgical problem, because the proportion of additional nitrogen and oxygen is uncontrolled. When aluminium-containing steel is being poured, the ambient air drawn in promotes the formation and possible deposition of alumina, especially in the somewhat cooler region of the discharge member (immersion pipe). It is therefore another object of the present invention to resolve this problem or at least to alleviate it considerably.

Summary of the Invention

The specified objects can be solved in a surprisingly simple way in accordance with the descsription of the invention, the drawings and the claims as stated herein.

The significance of the present invention resides in a two-dimensional relative movement between the valve member and the head plate of a sliding gate valve, wherein said relative movement is obtained either by the valve member or valve plate or the head plate individually the by correspondingly matched movement of the last-mentioned arrangement the sealing effect between the abutting surfaces of the head plate and the tundish bottom, on the one hand, and of the head plate and the valve plate or, respectivety, the valve plate and the pouring spout, on the other hand, is quite considerably improved. the specified abutting surfaces are "ground-in", so that the two-dimensional relative movement between said abutting surfaces results in a substantially complete sealing effect.

Due to the relative movement in accordance with the invention it is further provided that in the closed position of the valve member the molten metal in the pouring spout is stirred at least in the vicinity of the valve member, viz. the valve plate. In this way a considerably greater penetrating action is obtained in comparison with the result achieved by the mere reciprocating movement of the valve member as proposed in EP-A-66,118. Due to this increased penetrating action any freezing of the molten metal in the pouring spout is substantially prevented even in case of prolonged casting interruptions or breakdowns. The relative movement in accordance with the present invention causes a slight vertical rolating movement of the molten metal in the pouring spout, which additionally helps to prevent freezing of the molten metal.

Moreover, the relative movement provided in accordance with the invention continually varies the position of a shadow corner or a quiescent zone formed beneath the head plate, while the free cross-section of the pouring spout in this area retains a uniform size. Due to the "walking" shadow corner, oxide deposits in the vicinity of the slide valve are substantially prevented because washing-out is continually achieved. Due to the fact that in accordance with the varying position of the shadow corner the casting stream likewise continually rotates about the axis of the pouring spout, any possible oxide deposits in the somewhat cooler discharge member, i.e. the immersion pipe, are flushed away more efficiently and are thereby substanitally prevented.

The prevention of oxide deposits is therefore achieved in the open or part-open position of the slide valve both by the continual change of position of quiescent zones and by liquid flow moving about the axis of the pouring spout and also by the improved sealing effect between the abovementioned abutting surfaces.

In addition to the method according to the invention. The invention includes the casting apparatus for performing the method.

In conjunction with the movement of the valve member and/or the head plate, the invention futher includes a highly efficient way to vibrate off any alumina products that might be deposited in the cooler discharge member.

In the open or part-open position of the valve plate the invention provides means to avoid quiescent zones in the entire region of the pouring spout by moving the valve plate along a closed curved path, particularly a circular path, about the axis of the pouring spout. Because this occurs the shadow corner beneath the head plate and the shadow corner beneath the valve plate have their positions continually varied with both shadow corners being diametrically opposed to each other.

The invention is especially advantageous because it is readily applicable to conventional slide valves. Retrofitting of existing slide valves is unexpensive. For slide valves comprising changing and regulating cylinders it is merely necessary to "pulsate" the hydraulic system of these cylinders such that the valve performs the prescribed movements. The invention allows varied paths of movement to be obtained by combining two mutually perpendicular simple harmonic motions. Preferably, frequency and amplitude are individually adjustable. This is important even in the closed position of the valve. For example it is advantageous in a situation involving a breakdown of increasing duration to increase the frequency of the changing and regulating cylinders is correspondingly so as to obtain a more thorough "stirring" of the molten metal and thus obtain an improved penetrating action of the moving valve member. The same applies to correspondingly provided actuating mechanisms of the head plate. The mentioned increase in frequency substantially results in an increased velocity of the valve member and/or the head plate along the path. But even with a relatively low velocity of valve member and/or head plate a greater penetrating action is obtained in the closed position as compared to the known solution specified in EP-A-66,118, and this is due to the two-dimensional influence at every point of movement of the molten metal in the vininity of the valve plate.

Due to the penetrating action of a moving head plate by the inventive apparatus, it will suffice in many cases merely to drive said head plate oscillatingly, i.e. in reciprocating fashion. But even then a movement of the head plate along a closed curved path will be more advantageous because of the rotary movement of the molten metal in the pouring spout on top of the valve plate caused thereby, which rotary movement results in a more or less thorough vertical circulation of the molten metal.

Finally, it is conceivable as a further alternative that the valve plate and/or head plate in the closed position is/are made to rotate about the longitudinal axis of the pouring spout.

Therefore, the solution in accordance with the invention is highly advantageous both in the closed and in the open or part-open position of the valve the disclosed method and apparatus in the closed and in the open or part-open position are claimed as essential to the invention both independently of each other and in combination.

Embodiments of a casting apparatus, which is operated in accordance with the method of the invention, will be explained hereinbelow with reference to the accompanying drawings.

BRIEF DESCRIPTION OF THE DRAWINGS

FIG. 7 is a diagram for explaining the generation of relative movements of the head and/or valve plate from an X- and a Y-oscillating movement; (generation of (Lissajous) figures);

FIG. 8 is a block diagram for illustrating the generation of relative movements of head and/or valve plate, wherein relative movements of various types may be obtained;

FIG. 9 shows schematically an embodiment including a head plate adapted for movement along a closed curved path; and FIGS. 10*a* and 10*b* illustrate schematically the shadow corner which is moved about the longitudinal axis of the pouring spout in the case of a valve plate movable along a circular path, the centre of the circular path being concentric with the longitudinal axis of the pouring spout.

Figure 1:
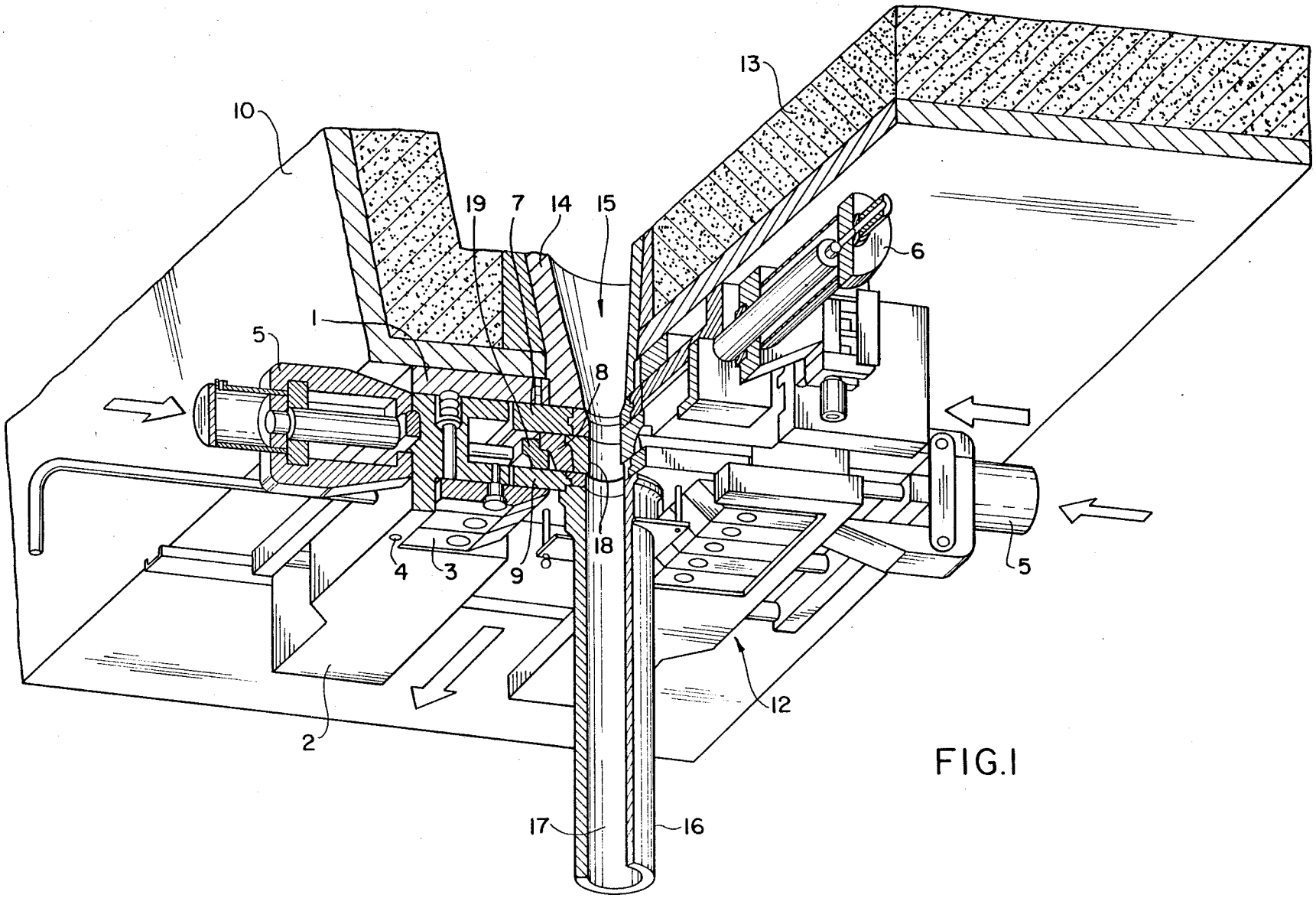
FIG. 1 is a first embodiment of a conventional slide valve for closing a tundish to which the method of the invention can be applied.
Figure 3:
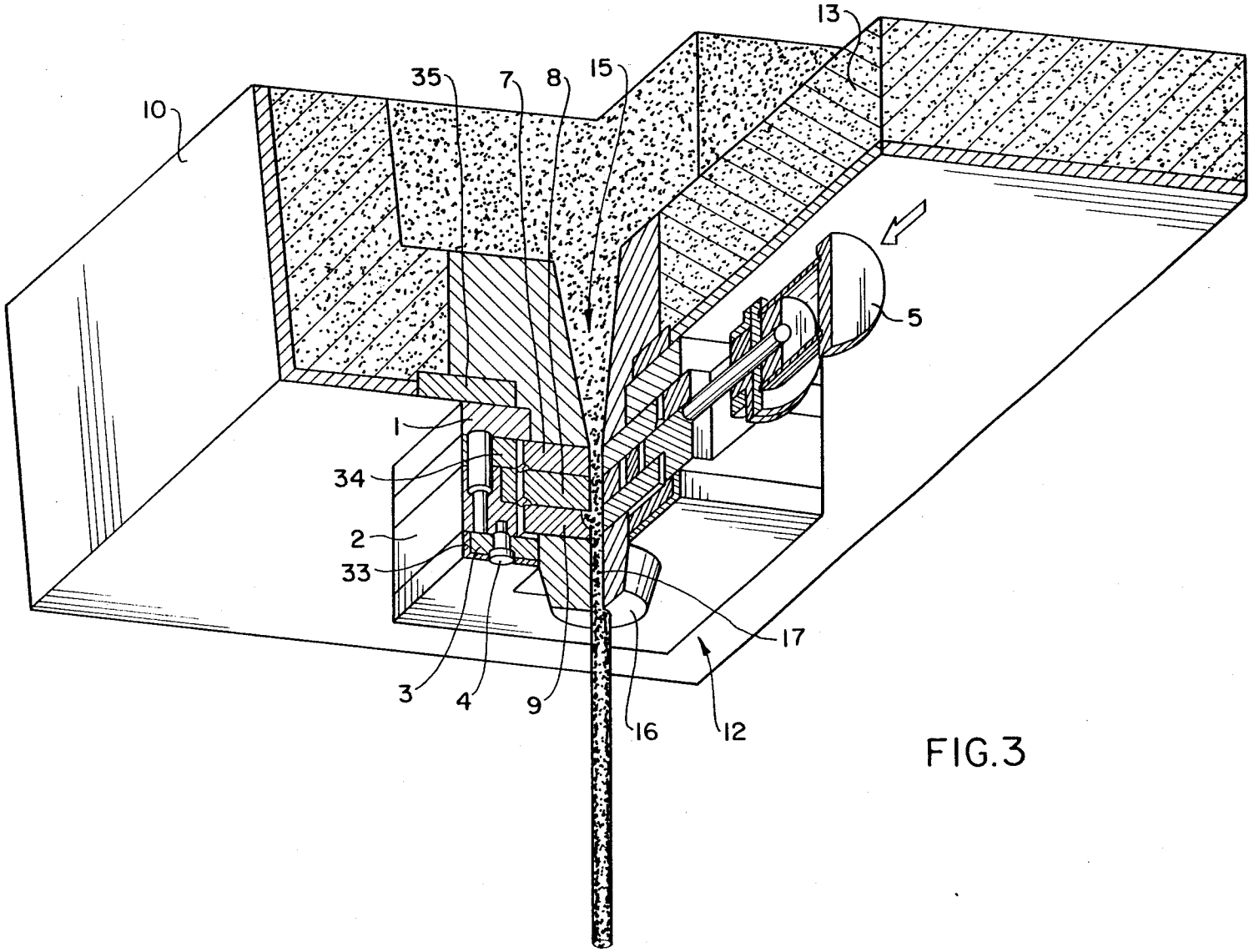
FIG. 3 is a second embodiment of a conventional slide valve to which the method of the invention may be applied.

DESCRIPTION OF THE PREFERRED EMBODIMENTS:

FIGS. 1 and 3 show the lower portion 10 of a tundish in the bottom 13 of which a discharge sleeve 14 of refractory material is disposed. The discharge sleeve 14 defines a top portion of a pouring spout 15 which extends downwardly inside the head plate 7 of a conventional slide valve generally referenced 12. The slide valve 12 comprises a plate-like movable valve member or valve plate 8, and a discharge member in the form of a discharge plate 8 rigidly connected to the head plate 7 and having an immersion pipe 16 attached thereto. Both the discharge plate 9 and the immersion pipe 16 are provided with a discharge hole 17 aligned with the pouring spout 15, while the valve plate 8 is formed with a passage 18.

The valve plate 9, which is sealingly mounted between head plate 7 and discharge platea 9 while it is movable transversely to the pouring spout 15, is movable by means of diametrically disposed regulating cylinders 5 between an open position, in which the passage 18 also is in alignment with the pouring spout 15, and a closed position in which the communication between the pouring spout 15 and the discharge hole 17 is interrupted. In the open position of the valve plate 8 the degree of opening of the passage 18 is adjusted by means of the hydraulically operated regulating cylinders 5.

Figure 2:
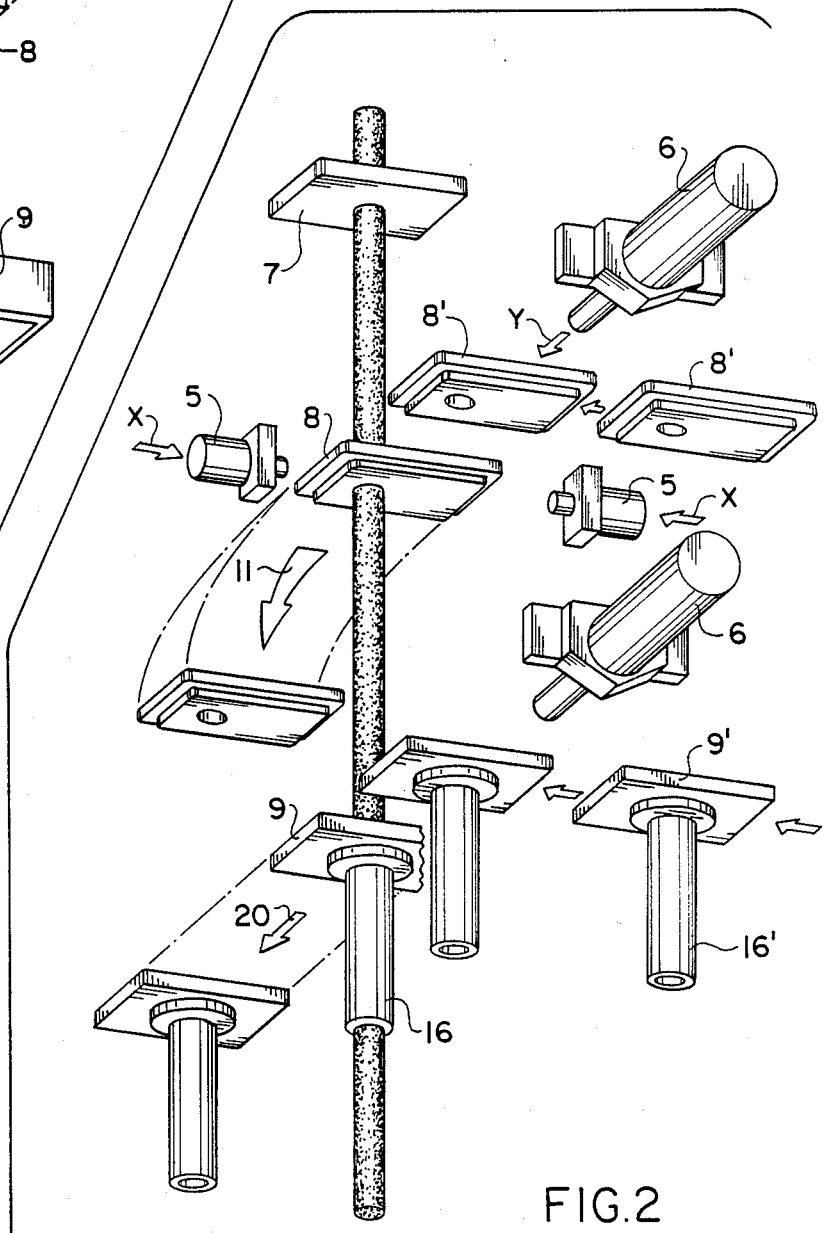
FIG. 2 is a schematic exploded view of the slide valve of FIG. 1, illustrating the operating principle thereof.

In the embodiment illustrated in FIGS. 1 and 2, the valve plate 8 also has a changing cylinder 6 associated therewith by means of which the valve plate 8 and also the discharge portion 9 may be changed without interrupting the casting process.

The operation of the regulating cylinders 5 and of the changing cylinder 6 are illustrated in detail in FIG. 2:

By means of the regulating cylinders 5, which are disposed and operate perpendicular to the alis of the pouring spout 15, the valve plate is moved as specified above, to the closed position, to the open position, or to any partially open position therebetween. The regulating cylinders 5 define a valve plate movement along the axis X—X, which is also called regulating axis.

When a valve plate 8 is to be changed, the changing cylinder 6 which is likewise disposed and operable perpendicular to the pouring spout 15 is actuated. The effective direction Y of the changing cylinder 6 being normal to the regulating axis X—X. The effective direction Y of the changing cylinder 6 defines the so-called changing axis.

A change of the valve plate 8 is effected by introducing a fresh valve plate 8' from the right-hand side (in FIG. 2) of the slide valve body to the middle. This valve plate 8' will then be between the changing cylinder 6 and the valve plate 8 which is in the casting position. By moving the changing cylinder 6 the fresh valve plate 8' is moved to the casting position within 0.2 seconds and the worn valve plate 8 is ejected towards the rear (arrow 11). (Thereafter the hydraulic changing cylinder 6 is retracted and permitting later insertion of another new valve plate).

In the retraction position the valve plate 8 or may be moved by the lateral regulating cylinders 5 to any choking position between 0% and 100% open.

Since the guide frames 19 (guide rails) for the control system remain in the same position even during the change of a valve plate, the fresh valve plate 8' is moved to the same position as that occupied by the previous valve plate 8. In this way a spontaneous flow rate variation is prevented. In FIG. 2, the change of plates is effected at "level 2". "Level 1" is defined by the head plate 7. The discharge plate or immersion pipe retaining plate 9 is disposed at the lowermost "level 3".

The change of valve plate 8 and the change of immersion pipe retaining plate 9 are performed by the same changing cylinder 6, but at different velocities. During normal operation locking bolts are disposed in front and to the rear of the immersion pipe retaining plate for keeping the immersion pipe stationary and for preventing movement thereof from the casting position due to the friction between immersion pipe retaining plate and valve plate upon a change of the valve plate.

When the immersion pipe is changed at "level 3" of FIG. 2, the valve plate 8 is moved by the regulating cylinders 5 to the closed position. When the casting stream has been interrupted and the tundish has been lifted hydraulically to such an extent that the immersion pipe 16 protrudes from the bath, the spare immersion pipe retaining plate 9' including a new immersion pipe 16' is moved from right to left in FIG. 2 into a lower lateral rack and is moved by the changing cylinder 6—this time at a substantially lower velocity—to the casting position. At the same time the former immersion pipe 16 is ejected rearwardly (arrow 20). As soon as the new immersion pipe is in said position, the locking pins are inserted and the tundish is lowered again. At the same time the valve plate 8 is moved from the closed to the open position and casting is resumed. Given a skilled team, the interruption of the casting process may be kept below 40 seconds. Nevertheless, already at such short interruptions of the casting process there is a risk of the melt freezing in the pouring spout 15. This risk is particularly great in case of unforeseen prolonged interruptions of the casting process.

In order to eliminate freezing of the melt in the pouring spout 15 and to avoid during operation, i.e. in the open or part-open position of the valve plate 8, any "static" shadow corners (quiescent zones) both beneath the head plate 7 and beneath the valve plate 8 the invention provides that of changing cylinder 6, the pressure plate 21 thereof is fixedly coupled to the guide frame 19 so that in cooperation with the regulating cylinders 5 the guide frame 19 and thus the valve plate 8 are movable in X- and Y-direction in such a way that the valve plate 8 both in the closed position and in the open or part-open position performs a movement along a closed curved path, preferably a circular path having its centre disposed in offset relationship to the longitudinal axis of the pouring spout 15. In FIGS. **10*a*, 10*b* said relative movement between valve plate 8, on the one hand, and head plate 7 or immersion pipe retaining plate 9, on the other hand, is illustrated as a schematic plan view. The valve plate 8 is moved along a circular path 43 whose center 44 is laterally offset relative to the longitudinal axis 45 of the pouring spout 15. The shadow corner beneath the head plate 7, which moves about the longitudinal axis 45 of the pouring spout 15 in the direction of the arrow 46, is indicated at 47. A corresponding shadow corner is formed diametrically opposite said shadow corner 47 beneath the valve plate 8. This shadow corner likewise moves in the direction of the arrow 46** so that static edges are prevented.

Preferably, the velocity of the valve plate 8 along the path, in this case along the circle, is approximately constant.

The two-dimensional relative movement between valve plate, on the one hand, and head plate or immersion pipe retaining plate, on the other hand, as illustrated in FIGS. **10*a*, 10*b* is also performed in the closed position of the valve plate 8. Thereby a relatively great mechanical influence on the molten metal in the vicinity of the valve plate 8 is obtained such that the molten metal is kept in motion and does not freeze. In the pouring spout 15 above the valve plate 8** a rotary motion is imparted to the molten metal, and consequently a more or less thorough vertical circulation of the molten metal is obtained, whereby the risk of the molten metal freezing is further reduced.

Of course, it would be conceivable to have the pressure plate 21 directly engage the valve plate 8'. In that case a cylinder would have to be provided in diametrically opposed relationship, and the valve plate 8 would be supported by the piston rod thereof, whereby the valve plates 8 and 8' can be reciprocated in Y—Y—direction in the already provided guide bars 19. Instead of the countercylinder, which is not illustrated, it is also possible to provide a resilient-action element, whereby the overall structure would be further simplified.

The hydraulic means normally associated with the regulating cylinders 5 and the changing cylinder 6 comprise a 4/3-type directional control valve 22 for normally controlling the change of immersion pipe and valve plate and a servo or proportional action valve 23 for controlling the regulating movements of the valve plate 8.

This known hydraulic circuit is complemented by a servo or proportional action valve 24. The latter is hydraulically connected between the hydraulic communication lines to the changing cylinder 6, and the hydraulic communication lines to the regulating cylinders 5. The first-mentioned connection being intermediate the changing cylinder 6 and the 4/3-type directional control valve 22 and the second-mentioned connection being upstream of the servo or proprotional action valve 23. The fluid communication with the servo or proportional action valve 24 is referenced 25, 26 in FIG. 6. The symbols "P" and "T" indicate the connection to the "pump" and the "tank", respectively.

The servo or proportional action valve 24 provides for the relative movement of the guide frame 19 and the valve plate 8 in the direction of the Y—Y—axis (changing axis). The movement of the quide frame 19 and the valve plates in the direction of the X—X—axis is performed by the regulating cylinders 5 which are provided in any case. In order to impart to the valve plate 8 a movement along a closed curved path, e.g. a circular path 43 as shown in FIGS. 10*a*, 10*b* and FIG. 7, respectively, a predetermined frequency is applied to the servo or proportional action valve 23. Simultaneously, a frequency is applied to the valve 24 valve 22 remains closed. Preferably, the frequencies are applied to the valves 23 and 24 with a phase shift, wherein at a phase shift of 90° the preferred circular motion of the guide frame 19 and of the valve plate 8, is obtained. in this respect reference is especially made to FIG.7. Accordingly, the so-called "master frequency $f_1$" is applied to the regulating cylinders 5, and the so-called "slave frequency $f_2$" is applied to the changing cylinder 6. Both oscillatory movements are offset by 90°. Thereby a uniform circular movement of the valve plate 8 in the closed and/or open or part-open position thereof is obtained. The mentioned frequencies therefore may be applied both in the closed and in the open or part-open position, i.e., in any position of the valve plate.

Figure 6:
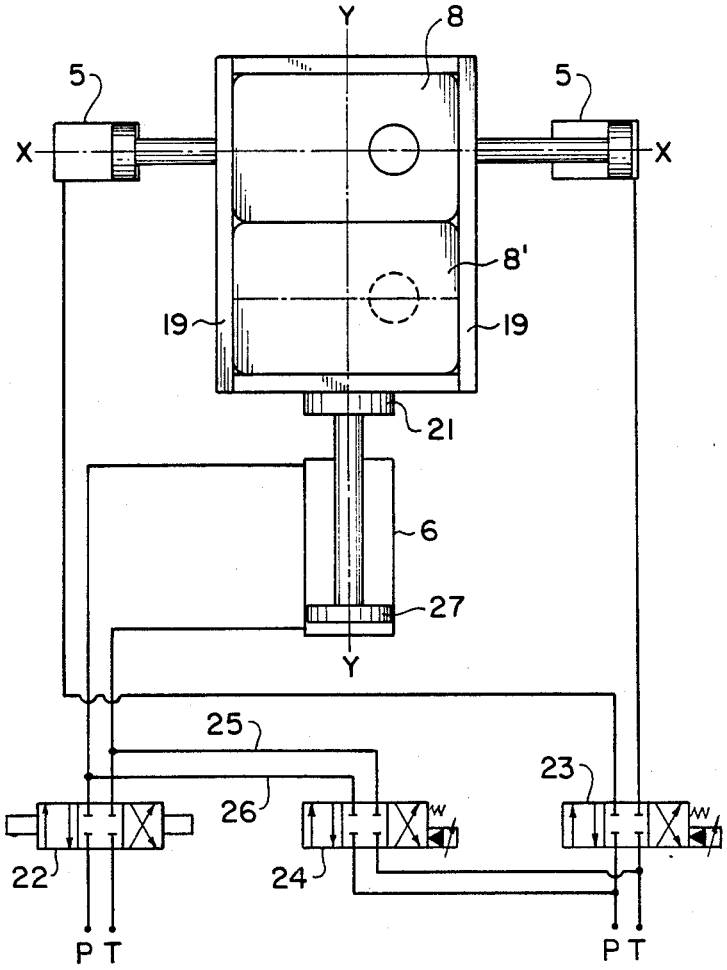
FIG. 6 is an hydraulic circuit diagram for controlling the tundish slide valve of FIGS. 1 and 2, illustrating an example of a modification thereof in accordance with the invention so that the valve plate may be moved as proposed by the invention.

When a plate or immersion pipe change is conducted, the applied frequencies of the valves 23 and 24 are turned off and the valve 22 is switched to the right-hand switching symbol in FIG. 6. It is provided that the mentioned frequencies can only be applied again to the valves 23 and 24 after return of the changing cylinder 6 (left-hand switching symbol of valve 22).

In order to prevent gradual drifting away of the piston 27 it may be advantageous at a predetermined timing of, for example, every 5 seconds during the frequency application to the valves 23 and 24 to apply a signal to the valve 24, whereby the piston 27 of the changing cylinder 6 is moved towards the bottom abutment in FIG. 6. FIG. 8 illustrates schematically the electronic control system for the application of frequencies to the valves 23 and 24. Accordingly, the pilot valves of the servo or proportional action valves 23, 24 each have variable output amplifiers 28, 29 associated therewith, a variable phase shifter 30 being connected to the input of the output amplifier 29. Both output amplifiers are controlled by a common frequency generator 31 which is variable in respect of frequency and, preferably, amplitude, wherein in the open or part-open position of the valve plate 8 and with a center of the path of movement of the valve plate offset relative to the longitudinal axis of the pouring spout, the amplitude 10 is selected to correspond at least to the distance between the center 44 of the (circular) path of movement 43 of the valve plate and the longitudinal axis 45 of the pouring spout 15. Thereby it is insured in any case that upon a movement of the valve plate 8 along the closed path, the pouring spout 15 is completely opened at least once, i.e. that it is free from shadow corners. In other words, in the open or part-open position the amplitude must be selected such that the path of movement extends through the longitudinal axis 45 of the pouring spout 15. If the closed path of movement includes the longitudinal axis 45 of the pouring spout 15, a shadow corner 47 being formed will move along the periphery of the pouring spout 15. In order to prevent in the open or part-open position of the valve plate 8 any variation of the free flow cross-section while the shadow corners 47 move along, frequency and amplitude in X- and Y-direction should be set such that the relative movement between valve platae 8, on the one hand, and head plate 7 or immersion pipe retaining plate 9, on the other hand, is along a closed circular path having its center on the longitudinal axis 45 of the pouring spout 15. In the closed position of the valve plate 8 the path of movement also may have a different contour, it may be elliptical, for example. In the closed position it is of paramount interest that said position is preserved.

Referring again to FIG. 8, the output amplifier 28 is allocated to the valve 23, and the output amplifier 29 is allocated to the valve 24. The valve 23 controls the movement of the valve plate in X—X—direction; the valve 24 is responsible for the movement of the valve plate in Y—Y—direction. By means of the phase shifter it is also possible to influence the contour of the curved path.

In the described embodiment as illustrated in particular also in FIG. 1, reference numeral 1 indicates a mounting plate, 2 indicates the valve body, 3 indicates a clamping system, and 4 indictes fastening bolts.

With refrence to FIGS. 3 to 5*b* the invention shall be explained by means of a second known embodiment of a slide valve for a tundish; parts of this slide valve which are identical to those of FIGS. 1 and 2 have been given the same reference characters. In this respect reference shall be made to the previous description.

Figure 4:
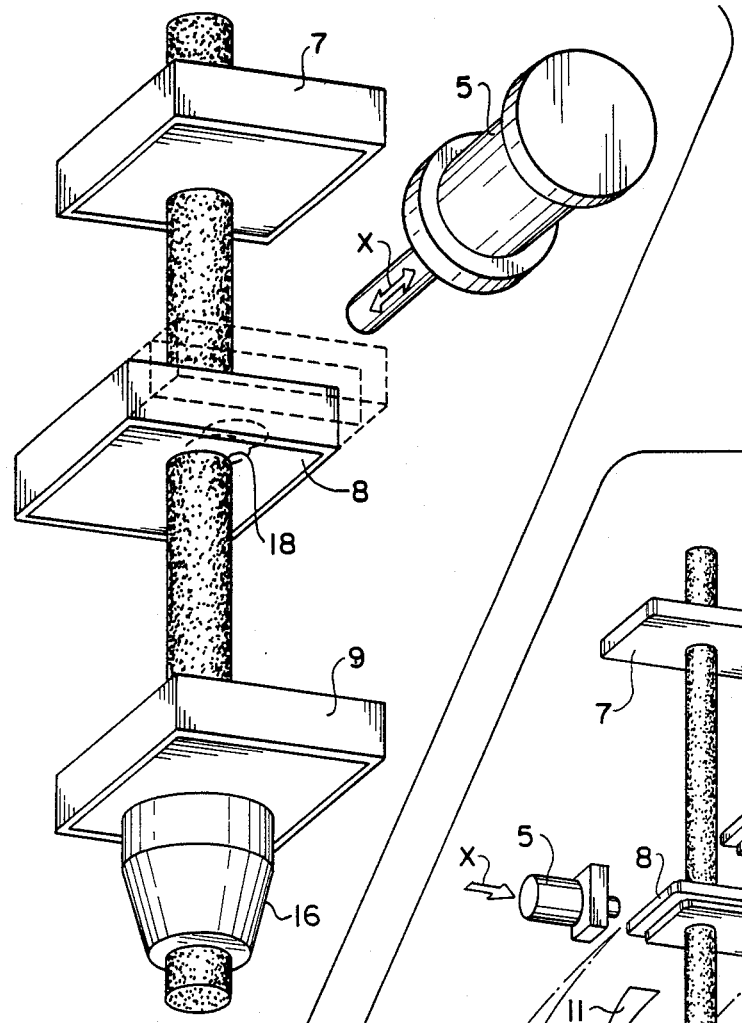
FIG. 4 is a schematic exploded view of the slide valve of FIG. 3, illustrating the operating principle thereof.

Accordingly, the slide valve 12 of this embodiment comprises a base plate 35 disposed in the bottom of the tundish. A mounting plate 1 is disposed beneath said base plate and is followed in downward direction by an intermediate plate 34. The undersurface of the intermediate plate has the valve body 2 attached thereto, which is again followed by a protective plate 33. Within the valve body 2 the valve plate 8 is movable perpendiclarly to the pouring spout 15 by means of a regulating cylinder 5 in the directin of the X—X—axis (regulating axis) to and from the closed position. The choking position of the valve plate 8 is controlled in a way which is similar to that of the embodiment of FIGS. 1 and 2. Since there is no separate changing cylinder, a change of plates during casting cannot be performed. Immersion pipe retaining plate 9 including the immersion pipe 16 may be changed by means of a separate manipulator. This is not shown in greater detail as it is sufficiently known. FIG. 4 shows schematically the operating principle of the slide valve of FIG. 3.

Figure 5A:
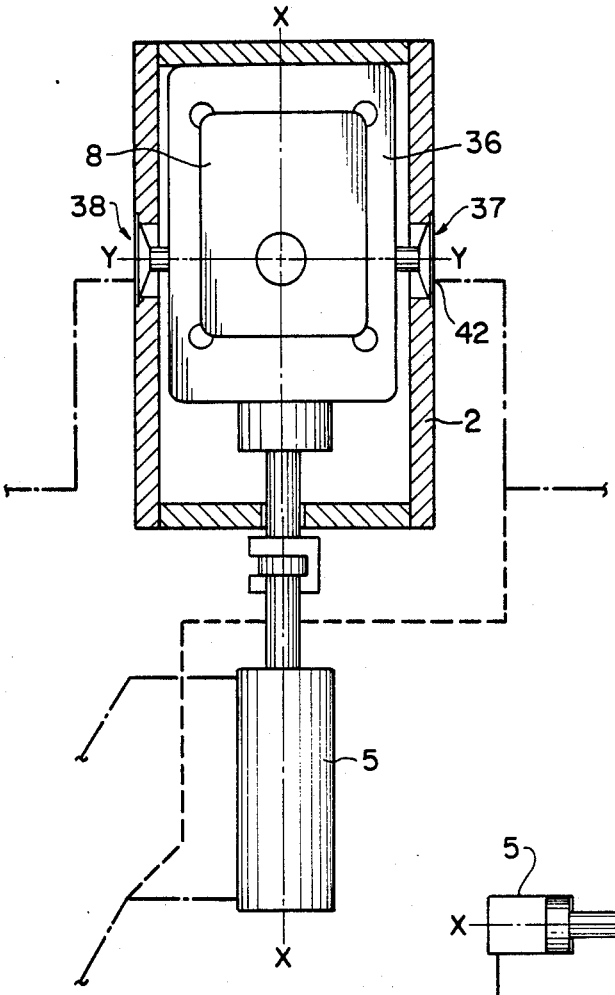
FIG. 5*a* is a schematic plan view showing an example of a modification of the slide valve illustrated in FIGS. 3 and 4 in accordance with the invention.
Figure 5B:
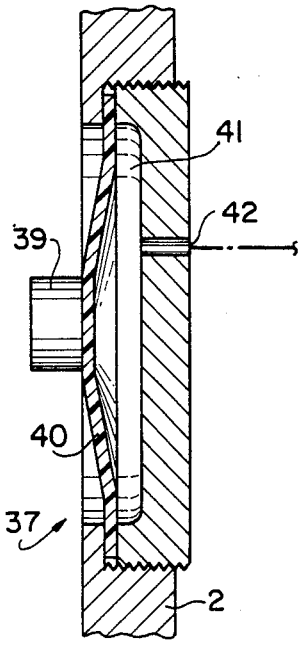
FIG. 5*b* is a schematic partial sectional view, showing an example of a modification of the slide valve illustrated in FIGS. 3 and 4 in accordance with the invention.

In order to obtain a movement of the valve plate along a closed curved path similar to that of the embodiment illustrated in FIGS. 1, 2 and 6–8, 10*a*, 10*b*, the mounting of the valve plate 8 inside the valve body 2 is modified in accordance with FIGS. 5*a*, 5*b*. The valve plate 8 is retained within a valve frame 36, to which the regulating cylinder 5 or its piston rod is coupled. By means of the regulating cylinder 5 the valve plate 8 including the valve frame 36 can be reciprocated in the direction of the regulating axis X—X. But in accordance with the invention this movement shall be superposed by a further movement in the direction of the Y—Y—axis which is transverse to the former and likewise extends transversely to the pouring spout. This is done by hydraulically actuated pressure elements 37, 38 which act on the sides of the valve frame 36. These pressure elements 37, 38 are mounted in fluid-tight fashion in the valve body 2. Preferably, the regulating cylinders 5 and the lateral pressure elements 37, 38 are actuataed via separate fluid lines and servo valves, and in order to achieve a circular motion of the valve plate within the valve body 2 the actuation of the regulating cylinder 5 and the lateral pressure elements 37, 38 must be performed with a phase shift of 90°. If the lateral pressure elements 37, 38 are connected in parallel with the regulating cylinder 5 (dashed line in FIG. 5*a*), a displacement of the frequencies by 180° will be possible only. Thereby only two possible, respectively straight oscillatory motions result each being inclined by 45° along the horizontal and being transverse to each other.

FIG. 5*b* is an enlarged sectional view showing an example of the structural configuration of the lateral pressure element 37. Accordingly, the pressure element 37 comprises a pressure plunger 39 having one end in engagement with the valve frame 36 and the other end in engagement with a diaphragm 40. The diaphragm 40 defines a fluid space 41 provided in the sidewall of the valve body 2 and having a pressure fluid port opening thereinto. Pulsations of the pressure fluid are therefore transmitted through the port 42 and the fluid space 41 to the diaphragm 40 and thus to the plunger 39. Accordingly, the slide frame 36 and therefore the valve plate 8 are engaged or moved laterally. The application of pressure to the diametrically opposed pressure element 38 is respectively conducted in opposition to that of the pressure element 37.

One of the two pressure elements 37 or 38 may be replaced by a resilient element, for example by a mechanical spring or a pneumatic spring.

FIG. 9 shows schematically the action on the head plate 7 in X- and/or Y-direction, wherein the movement of the head plate 7 may be conducted similarly to the movement of the valve plate 8 as described previously. To this end the head plate 8 may be coupled to regulating cylinders acting in X- and/or Y-direction. Preferably, the head plate 7 is disposed in a plate frame corresponding to the valve frame 36 of FIG. 5*a* and the head plate frame is mounted within a head plate body for reciprocating movement in X- and Y-direction, which may likewise correspond to the mounting of the valve frame 36 inside the valve body 2 of FIG. 5*a*. For moving the head plate in X- and/or Y-direction, pressure elements corresponding to the pressure elements 37, 38 of FIG. 5*a* and 5*b* and mounted within the head plate body (not illustrated) may engage the head plate. The hydraulic actuation of the pressure elements can be effected in accordance with FIG. 6. Accordingly, in an extreme case an oscillatory movement of the head plate 7 perpendicularly to the pouring spout and also a movement of the head plate 7 along a closed curved path, e.g. a circular or elliptical path, is possible. The movement of the head plate 7 in the described form may likewise take place both in the closed and in the open position of the valve plate 8.

At the same time the valve plate 8 may be moved in the way described above, so that the total movements of head plate 7 and valve plate 8 are superposed. In case of a phase shift of the circular motion it is possible in the closed position of the valve plate to obtain an even higher agitating action on the molten metal disposed above the valve plate 8.

An especially simple construction is characterized in that the valve plate 8 and the head plate 7 each oscillate or reciprocate perpendicularly to the pouring spout 15, wherein the oscillating means X, Y are transbers to each other and are matched with one another so that between valve plate and head plate a relative motion along a closed curved path will be generated, and that especially in the open or part-open position of the valve plate 8 relative to the head plate 7 an approximately meniscal shadow corner 47 will be formed which is moved about the axis of the pouring spout 15; this relative movement between valve plate and head plate may also be performed in the closed position. Of course, in the closed position there is no true shadow corner but merely an "imaginary" shadow corner. With this embodiment it is only necessary to couple to the head plate an oscillatingly driven cylinder-piston unit (preferably hydraulically actuated) such that the head plate is reciprocated in Y-direction while the valve plate is reciprocated in X-direction. In this way it is possible to obtain the same relative movement between head plate and valve plate as that obtained by the movement of the valve plate alone or the head plate alone in accordance with the above-described method.

Independently of the described invention, but also in combination therewith, the immersion pipe or the immersion pipe retaining plate 9 may be coupled to a vibrating means (not illustrated) in order to remove or vibrate off any alumina deposits in the discharge hole 17 of the immersion pipe 16. In the embodiment shown in FIGS. 1 and 2, this is preferably done by means of the changing cylinder 6 with the valve plate 8 closed. After coupling of the changing cylinder 6 to the discharge portion comprised of immersion pipe retaining plate 9 and immersion pipe 16 it is merely necessary to apply a sufficiently high frequency to the changing cylinder 6. The frequency application may be conducted, for example, by means of the servo or proportional action valve 24 including the variable pilot valve, as described with reference to FIG. 6.

For the rest, it should be noted that ambient air tends to be drawn in the vicinity of quiescent zones or of shadow corners air, so that in addition to the elimination of static edges the sealing effect achieved by the relative movement according to the invention is of paramount significance.

All of the features disclosed in the present documents are claimed as being essential to the invention to the extent to which they are novel over the prior art either individually or in combination.

We claim:

1. A method of controlling the pouring spout of a molten metal tundish, said tundish having a sliding valve mounted thereunder, said sliding valve comprising a valve plate for opening, closing and partial opening movement between a head plate and a discharge member, said head plate being mounted on the underside of said tundish comprising the steps of:

moving said valve plate in two directions perpendicular to each other in a plane perpendicular to the longitudinal axis of said pouring spout moving the head plate in two directions perpendicular to each other in a plane perpendicular to the longitudinal axis of the pouring spout oscillatingly moving said plate in said direction perpendicular to the longitudinal axis of the pouring spout, the directions of oscillation extending at a phase angle of 90° to each other and the oscillating movements being matched with each other such that a relative movement resulting between the valve plate and the head plate is generated along a closed curve path concentric with the longitudinal axis of the pouring spout.

2. A method of controlling the pouring spout of a molten metal tundish, said tundish having a sliding valve mounted thereunder, said sliding valve comprising a valve plate for opening, closing, and partial opening movement between a head plate and a discharge member, said head plate being mounted on the underside of said tundish comprising the steps of moving said valve plate in two directions perpendicular to each other in a plane perpendicular to the longitudinal axis of said pouring spout oscillatingly moving said plate in said two directions substantially perpendicular to each other, such that the resulting movement is a combination of two mutually perpendicular harmonic motions.

3. The method of claim 2 including the step of moving the head plate in two directions perpendicular to each other in a plane perpendicular to the longitudinal axis of the pouring spout.

4. A method of controlling the pouring spout of a molten metal tundish, said tundish having a sliding valve mounted thereunder, said sliding valve comprising a valve plate for opening, closing, and partial opening movement between a head plate and a discharge member, said head plate being mounted on the underside of said tundish comprising the steps of moving said valve plate in two directions perpendicular to each other in a plane.perpendicular to the longitudinal axis of said pouring spout oscilltingly moving said plate in said two directions substantially perpendicular to each other, such that the resulting movement is a combination of two mutually perpendicular harmonic motions.

5. Sliding gate valve apparatus adapted to be used with a molten metal tundish, said tunding having a pouring spout located at the underside thereof, said sliding gate valve comprising a head plate having an opening therethrough in fluid flow communication with said pouring spout a discharge member having a discharge tube attached thereto a valve plate interposed between said head plate and said discharge member, said valve plate having an opening therethrough, and being movable between an open position and a closed position and a partially open position therebetween actuating means for moving said valve plate in two directions in a plane perpendicular to the longitudinal axis of the pouring spout comprising a hydraulically operated changing piston-cylinder and a hydraulically operated regulatory piston-cylinder, each being driven by an oscillating signal having a phase shift of 90° relative to each other.

6. Sliding gate valve apparatus adapted to be used with a molten metal tundish, said tunding having a pouring spout located at the underside thereof, said sliding gate valve comprising a head plate having an opening therethrough in fluid flow communication with said pouring spout a discharge member having a discharge tube attached thereto a valvue plate interposed between said head plate and said discharge member, said valve plate having an opening therethrough, and being movable between an open position and a closed position and a partially open position therebetween actuating means for moving said valve plate in two directions in a plane perpendicular to the longitudinal axis of the pouring spout and means attached to said pouring spout for vibrating said pouring spout.

7. The apparatus of claim 6, including actuating means for moving said head plate in two directions in a plane perpendicular to the longitudinal axis of the pouring spout.

8. Sliding gate valve apparatus adapted to be used with a molten metal tundish, said tunding having a pouring spout located at the underside thereof, said sliding gate valve comprising a head plate having an opening therethrough in fluid flow communication with said pouring spout a discharge member having a discharge tube attached thereto a valve plate interposed between said head plate and said discharge member, said valve plate having an opening therethrough, and being movable between an open position and a closed position and a partially open position therebetween actuating means for moving said head plate in two directions in a plane perpendicular to the longitudinal axis of the pouring spout, and means attached to said pouring spout for vibrating said pouring spout.

9. The apparatus of claim 7, 6, or 8 including an oscillator for controlling said vibrating means.

10. The apparatus of claim 7, 6, or 8 wherein said vibrating means comprises an ultrasonic vibrator.

11. The apparatus of claim 7, 6, or 8 wherein said vibrating means vibrates said pouring spout in at least one direction perpendicular to the longitudinal axis of the pouring spout.

* * * * *